US006068459A

United States Patent [19]

Clarke et al.

[11] Patent Number: 6,068,459

[45] Date of Patent: May 30, 2000

[54] TIP SEAL FOR SCROLL-TYPE VACUUM PUMP

[75] Inventors: Hans T. Clarke, Berlin; Anthony G. Liepert, Lincoln, both of Mass.

[73] Assignee: Varian, Inc., Palo Alto, Calif.

[21] Appl. No.: 09/026,021

[22] Filed: Feb. 19, 1998

[51] Int. Cl.[7] ..... F01C 1/02

[52] U.S. Cl. ..... 418/55.4; 418/142; 277/458; 277/589

[58] Field of Search ..... 418/55.4, 142; 277/458, 589

[56] References Cited

U.S. PATENT DOCUMENTS

| | | | |
|---|---|---|---|
| 801,182 | 10/1905 | Creux . | |
| 3,994,636 | 11/1976 | McCullough et al. | 418/55 |
| 4,702,482 | 10/1987 | Oseman | 277/589 |
| 4,730,375 | 3/1988 | Nakamura et al. | 29/156.4 R |
| 4,883,413 | 11/1989 | Perevuznik et al. | 418/55 |
| 5,258,046 | 11/1993 | Haga et al. | 418/55 |
| 5,366,358 | 11/1994 | Grenci et al. | 418/55.4 |

FOREIGN PATENT DOCUMENTS

| | | | |
|---|---|---|---|
| 0520487 A1 | 12/1992 | European Pat. Off. . | |
| 42 08 597 A1 | 10/1992 | Germany . | |
| 59-176486 | 10/1984 | Japan | 418/142 |
| 4-308383 | 10/1992 | Japan | 418/142 |
| 6-207588 | 7/1994 | Japan | 418/142 |
| 07109981 | 4/1995 | Japan . | |
| 08100776 | 4/1996 | Japan . | |
| 09032756 | 2/1997 | Japan . | |
| 10009158 | 1/1998 | Japan . | |

*Primary Examiner*—Thomas Denion
*Assistant Examiner*—Theresa Trieu
*Attorney, Agent, or Firm*—William R. McClellan; Bella Fishman

[57] ABSTRACT

A tip seal for use in a scroll-type vacuum pump includes a seal element and an energizer element affixed to the seal element. The scroll-type vacuum pump includes first and second scroll blades that are nested together to define one or more interblade pockets, and an eccentric drive that produces orbiting movement of the first scroll blade relative to the second scroll blade. At least one of the first and second scroll blades has a seal groove along an edge thereof. The tip seal is positioned in the seal groove between the first and second scroll blades. The energizer element is formed of a resilient material having multiple compressible voids, so that the energizer element having compressible voids is more compressible than the resilient material alone, when confined by the seal groove. In one embodiment, the energizer element is a foam such as a low porosity urethane foam. In another embodiment, the energizer element is an elastomer material having a predetermined pattern of voids.

9 Claims, 3 Drawing Sheets

TIP SEAL FOR SCROLL-TYPE VACUUM PUMP

FIELD OF THE INVENTION

This invention relates to scroll-type vacuum pumps and, more particularly, to improved tip seals which permit the scroll-type vacuum pump to operate across a relatively large pressure differential.

BACKGROUND OF THE INVENTION

Scroll pumps are disclosed in U.S. Pat. No. 801,182 issued in 1905 to Creux. In a scroll pump, a movable spiral blade orbits with respect to a fixed spiral blade within a housing. The configuration of the scroll blades and their relative motion traps one or more volumes or "pockets" of a fluid between the blades and moves the fluid through the pump. The Creux patent describes using the energy of steam to drive the blades to produce rotary power output. Most applications, however, apply rotary power to pump a fluid through the device. Oil-lubricated scroll pumps are widely used as refrigerant compressors. Other applications include expanders, which operate in reverse from a compressor, and vacuum pumps. To date, scroll pumps have not been widely adopted for use as vacuum pumps, mainly because the cost of manufacture for a scroll pump is significantly higher than for a comparably sized oil lubricated vane pump.

Scroll pumps must satisfy a number of often conflicting design objectives. The scroll blades must be configured to interact with each other so that their relative motion defines the pockets that transport, and often compress, the fluid within the pockets. The blades must therefore move relative to each other, with seals formed between adjacent turns. In vacuum pumping, the vacuum level achievable by the pump is often limited by the tendency of high pressure gas at the outlet to flow backwards toward the lower pressure inlet and to leak through the sliding seals to the inlet. The effectiveness and durability of the scroll blade seals are important determinants of performance and reliability.

Sealing means for scroll-type apparatus, including a seal element backed by an elastomeric member, are disclosed in U.S. Pat. No. 3,994,636 issued Nov. 30, 1976 to McCullough et al. A seal configuration including a sealing strip biased by a silicone rubber tube is disclosed in U.S. Pat. No. 4,883,413 issued Nov. 28, 1989 to Perevuznik et al. A seal arrangement for a scroll-type vacuum pump, including a seal element and an elastomer seal loading bladder which may be pressurized, is disclosed in U.S. Pat. No. 5,366,358 issued Nov. 22, 1994 to Grenci et al. A scroll-type pump having a seal configuration, including a seal member and a backup member of a soft porous material, is disclosed in U.S. Pat. No. 5,258,046 issued Nov. 2, 1993 to Haga et al. Additional seal configurations for scroll-type apparatus are disclosed in U.S. Pat. No. 4,730,375 issued Mar. 15, 1988 to Nakamura et al. Prior art tip seals typically include a seal element that forms a sliding seal and an energizer element that forces the seal element against an opposing surface.

Tip seals critically affect the performance and reliability of dry scroll pumps. The tip seal is typically mounted in a groove machined into the top edge of a scroll blade. The seal must effectively block gas leakage across the seal (transverse to the seal) as well as axially along the tip seal groove. Leakage in either direction allows gas to travel back toward the pump inlet. The seal must provide adequate sealing for long periods of time (typically more than 9000 hours) with little wear, minimal friction and over a range of operating temperatures and pressures. The tip seals in prior art scroll-type vacuum pumps have a number of disadvantages that relate to elastomeric material properties, economically achievable machining tolerances and conflicting requirements of low leakage across and down the seal. Common elastomers such as rubber, Buna N and Viton are incompressible materials, i.e., the material density remains essentially constant under compressive stresses. Squeezing a cube of these materials vertically results in the material bulging out horizontally. For an elastomer seal located in a groove and having no space in which to deform, the seal will support very high vertical forces with essentially no vertical deformation. Consequently, to completely fill a seal groove under the light pressures required for low friction and long life, the dimensions of the seal, the seal groove and the clearance to the opposing scroll blade must be very tightly controlled. As a practical matter, tradeoffs must be made with solid elastomers as to how well the seal groove can be blocked. This limits pump performance.

Solid elastomers such as Viton, Buna N and molded silicones are also too stiff to use as seal energizer elements in a practical scroll pump. A typical modulus of elasticity for these materials is 200 to 700 pounds per square inch (psi). To limit frictional heating within the pump, the contact pressure must be kept low, ideally less than about 5 psi. If the elastomeric portion of the seal is 0.1 inch thick, then a 5 psi loading is achieved with Buna N with a deflection of only 0.001 inch. Tolerances within the pump must be held extremely tight to consistently achieve a 5 psi loading. Seal loading would change substantially with seal wear and with thermal expansion of scroll components as the pump operates.

One commercially available dry scroll vacuum pump uses unsintered Teflon paste as a seal energizer element. A useful attribute of Teflon paste is that it is a non-homogeneous material. A fraction of the material is air and, therefore, its bulk density can be increased by compaction. When the seal is pressed into the tip seal groove, the elastomer simultaneously yields and compresses to fill the seal groove nearly completely. The material takes a permanent set but, when released, springs back very little. This effectively blocks transverse leakage under the seal as well as along the tip seal groove. The energizer compensates for dimensional variations by deforming and compressing more or less without great variation in force. This is in contrast to a solid elastomer, which greatly resists deformation when dimensionally confined.

The design using a Teflon paste energizer element, however, has several disadvantages. When the scroll pump is started, its internal components gradually heat up due to friction and work performed on the gas being pumped. The Teflon paste expands in the groove relative to the surrounding metal and forces the seal surface against its counterface. When a new seal is first run, the Teflon paste compresses a bit further, taking a new permanent set. The proper initial paste density, width and thickness are adjusted, so that adequate sealing force is available at normal operating temperatures. Consequently, elevated temperature is necessary to ensure sufficient force to properly energize the seal. The energizer element must be in a thermally expanded state to function properly. Scroll pumps using this type of paste elastomer and started at low ambient temperatures often exhibit poor base pressure for many minutes until the pump and seals have warmed up. This behavior is unacceptable for some applications such as, for example, portable leak detection systems.

Another disadvantage of the Teflon paste elastomer is a loss of seal energizing force due to wear. Over time, both the seal and the counterface wear and become thinner. The wear is small, on the order of 0.003 inch per year of operation. However, after about a year, the thermal expansion of the Teflon paste is no longer sufficient to force the seal against the counterface. A degradation of pump base pressure results from increased leakage across the top of the seal. Although a large amount of seal material remains, the seals must be replaced.

A final disadvantage of the Teflon paste is that it is quite expensive. The material required to make seals for one pump costs about forty dollars.

Accordingly, there is a need for improved tip seal configurations for scroll-type vacuum pumps.

SUMMARY OF THE INVENTION

According to a first aspect of the invention, vacuum pumping apparatus is provided. The vacuum pumping apparatus comprises a scroll blade set having an inlet and an outlet, and an eccentric drive operatively coupled to the scroll blade set. The scroll blade set comprises a first scroll blade and a second scroll blade that are nested together to define one or more interblade pockets. At least one of the first and second scroll blades has a seal groove along an edge thereof. The eccentric drive produces orbiting movement of the first scroll blade relative to the second scroll blade so as to cause the interblade pockets to move toward the outlet. The vacuum pumping apparatus further comprises a tip seal positioned in the seal groove between the first and second scroll blades. The tip seal comprises a seal element and an energizer element affixed to the seal element. The energizer element comprises a resilient material having multiple compressible voids, such that the energizer element having compressible voids is more compressible than the resilient material alone, when confined by the seal groove.

In a first embodiment, the energizer element comprises a foam, such as a low porosity urethane foam. The foam preferably has a modulus of elasticity no greater than about 40 psi.

In a second embodiment, the energizer element comprises an elastomer material and the compressible voids comprise a predetermined pattern of voids, which may be molded into the elastomer material. The voids may extend to the bottom surface of the seal groove. The elastomer material may comprise a silicone compound having a low modulus of elasticity. The elastomer material with voids preferably has a modulus of elasticity no greater than about 100 psi.

According to another aspect of the invention, a tip seal for use in a scroll-type pump is provided. The scroll-type pump includes first and second scroll blades that are nested together to define one or more interblade pockets, at least one of the first and second scroll blades having a seal groove along an edge thereof. The tip seal is positioned in the seal groove between the first and second scroll blades and comprises a seal element and an energizer element affixed to the seal element. The energizer element comprises a resilient material having multiple compressible voids, so that the energizer element having compressible voids is more compressible than the resilient material alone, when confined by the seal groove.

BRIEF DESCRIPTION OF THE DRAWINGS

For a better understanding of the present invention, reference is made to the accompanying drawings, which are incorporated herein by reference and in which.

DESCRIPTION OF THE PREFERRED EMBODIMENTS

Figure 1:
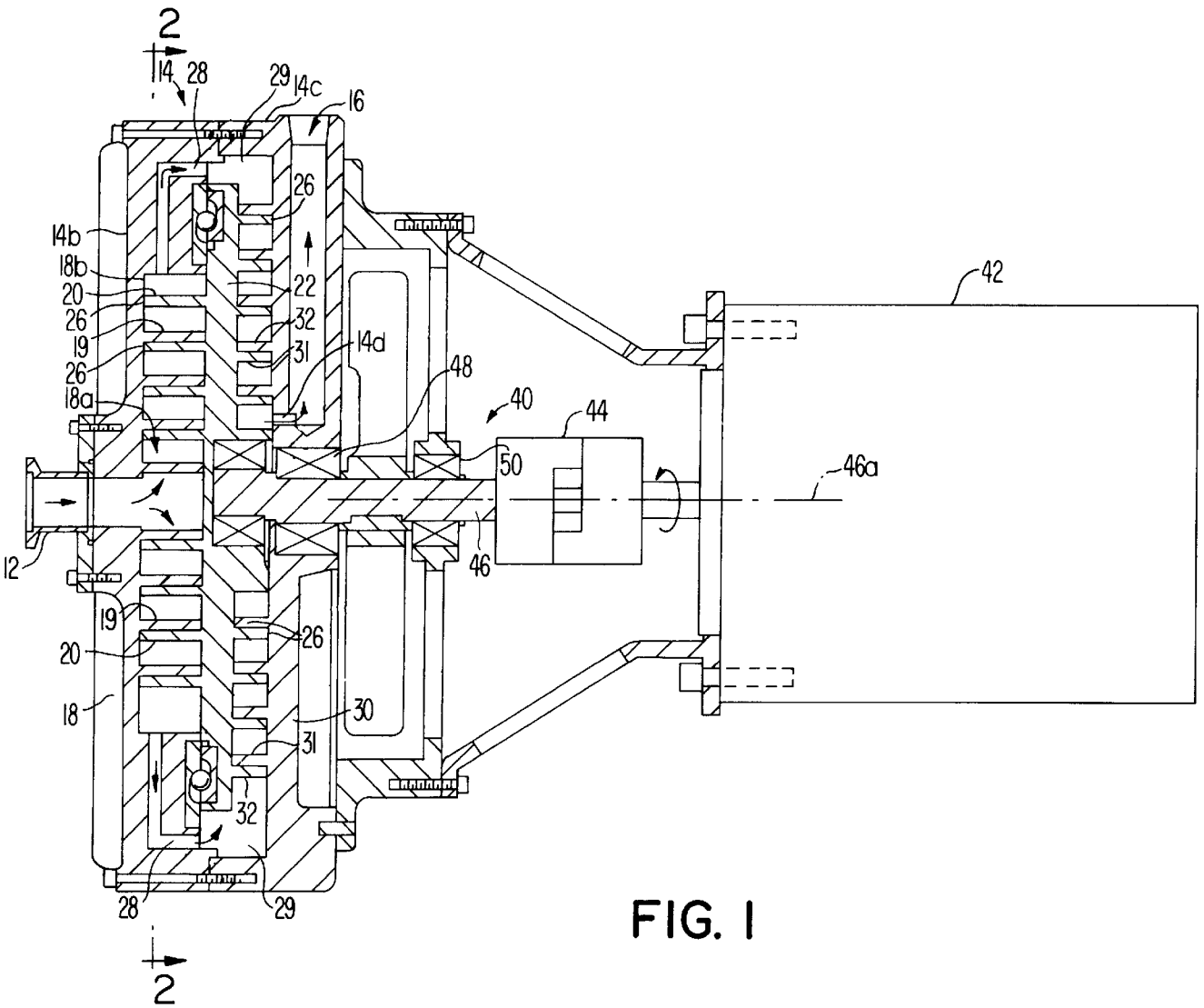
FIG. 1 is a cross-sectional view of an example of a scroll-type vacuum pump suitable for incorporation of the tip seal of the invention.
Figure 2:
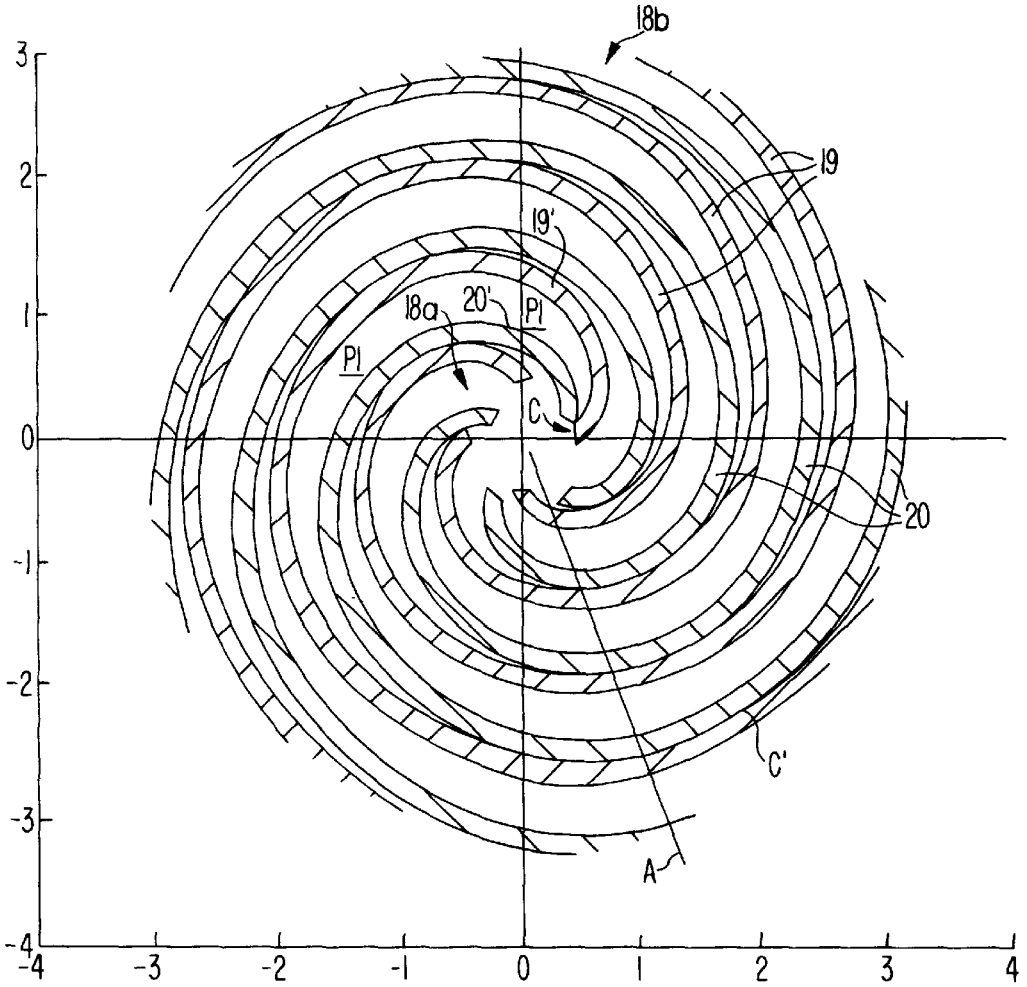
FIG. 2 is a cross-sectional view of the first scroll blade set, taken along the line 2—2 of FIG. 1.

An example of a scroll-type vacuum pump suitable for incorporation of the present invention is shown in FIGS. 1 and 2. A dry, two-stage vacuum pump is shown. A gas, typically air, is evacuated from a vacuum chamber or other equipment (not shown) connected to a vacuum inlet 12 of the pump. A housing 14 includes a housing portion 14*b* that encloses and in part defines a first pump stage 18 and a housing portion 14*c* that encloses and in part defines a second pump stage 30. An outlet port 14*d* is formed in the second stage housing near its center. The outlet port communicates with a radially-directed, high pressure discharge passage 16 in housing portion 14*c*, venting to atmosphere at the outer periphery of the housing.

The first scroll pump stage 18 is located within the housing with an inlet region 18*a* connected to vacuum inlet 12. As shown in FIG. 2, scroll pump stage 18 may be formed by four pairs of nested spiral shaped scroll blades. Each blade pair includes a stationary blade 19 and an orbiting blade 20. The scroll blade 19 is preferably formed integrally with housing portion 14*b* to facilitate heat transfer and to increase the mechanical rigidity and durability of the pump. The blade 20 is preferably formed integrally with a movable plate 22. The blades 19 and 20 extend axially toward each other and are nested as shown in FIGS. 1 and 2. Orbital motion of plate 22 and scroll blade 20 produces a scroll-type pumping action of the gas entering the scroll blades at the inlet region 18*a*.

The free edge of each blade 19 and 20 carries a continuous tip seal 26 as described in detail below. The blades 19 and 20 extend axially toward plate 22 and housing portion 14*b*, respectively, so that there is a sliding seal at the edge of each blade.

Gas exits scroll pump stage 18 at its outer periphery 18*b*, where it flows through channels 28 formed in housing portion 14*b* to an annular inlet region of second scroll pump stage 30 surrounded by an annular plenum chamber 29. The second scroll pump stage 30 includes a stationary scroll blade 32 and an orbiting scroll blade 31, each of which carries a tip seal 26 on its free edge. The tip seal establishes a sliding seal between each blade and an opposing surface. The scroll blades of the first and second pump stages may have different blade heights and different numbers of turns to achieve a desired pump performance. As scroll blade 20 orbits relative to scroll blade 19, pockets formed between the scroll blades, such as pocket PI shown in FIG. 2, move from the inlet of the scroll pump stage toward the outlet and pump gas from the inlet to the outlet.

An eccentric drive 40 for pump stages 18 and 30 is powered by a motor 42 connected by a coupling 44 to a drive shaft 46 mounted in axially spaced bearings 48 and 50. The eccentric drive 40 produces orbiting movement of plate 22 with respect to an axis of rotation 46*a* of drive shaft 46. Additional details regarding the construction and operation of the scroll-type vacuum pump of FIGS. 1 and 2 are given in U.S. Pat. No. 5,616,015, issued Apr. 1, 1997, which is hereby incorporated by reference. It will be understood that the tip seal of the present invention may be utilized in a two-stage scroll-type vacuum pump, as shown in FIGS. 1 and 2 and described above, may be utilized in a single-stage scroll-type vacuum pump, or may be utilized in any other scroll-type apparatus.

In accordance with the invention, a tip seal for a scroll-type vacuum pump includes a seal element and an energizer element. The seal element establishes a sealed, sliding contact with an opposing surface of the vacuum pump. The energizer element forces the seal element into contact with the opposing surface. The energizer element is affixed to the seal element, typically by an adhesive, to form a unitary tip seal. The energizer element is fabricated of an elastomer material with compressible voids. The durometer of the elastomer material and the size and geometry of the voids are selected such that the energizer element readily conforms to the seal groove, so that little force is required to deform the energizer element to the point where the seal groove is nearly completely filled. The compressible voids cannot present a leakage path, either across the seal or along the seal groove. The elastomer material with compressible voids has a low effective modulus of elasticity, so that a low uniform loading is achieved, even after the seal groove is completely filled.

Figure 3:
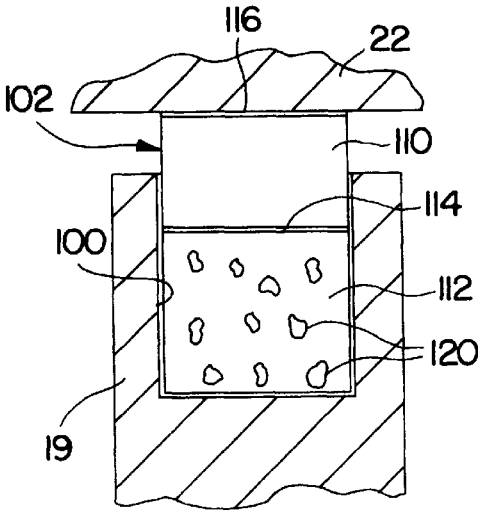
FIG. 3 is an enlarged, partial cross-sectional view of a scroll blade, illustrating a first embodiment of the tip seal of the invention.

A first embodiment of the tip seal is shown in FIG. 3. A partial cross-sectional view of a tip of scroll blade 19 is shown. The upper edge of scroll blade 19 is provided with a tip seal groove 100, typically having a rectangular cross section. Groove 100 follows the edge of scroll blade 19 and has a spiral configuration. A tip seal 102 is positioned in groove 100 between scroll blade 19 and plate 22. The tip seal 102 comprises a seal element 110 and an energizer element 112 affixed to seal element 110 with an adhesive 114. A surface 116 of seal element 110 contacts plate 22 and slides with respect to plate 22 to provide a sliding seal between scroll blade 19 and plate 22 during operation of the scroll pump. Referring to FIG. 1, it will be understood that scroll blades 20, 31 and 32 may be provided with the seal configuration shown in FIG. 3 for enhanced performance of the scroll-type vacuum pump.

In the embodiment of FIG. 3, the energizer element 112 comprises a foam having compressible voids 120. The foam material may be a urethane foam. A preferred material is a microcellular urethane foam manufactured by Poron as Part No. 4701-21. The voids within the foam are connected by very small passages. The foam is initially compressed about 14% when installed in a pump. This results in a seal loading of about 5 psi. The initial compression of the foam substantially collapses the voids and passages to allow essentially no leakage through the foam matrix. The modulus of elasticity of this material is about 40 psi. The above-identified foam can be purchased with a contact adhesive on one side, which may be used to attach the energizer element 112 to the seal element 110. Both the urethane foam and the adhesive can tolerate the maximum operating temperatures within a dry scroll pump (about 200 EF).

Whether or not a particular foam performs adequately is a matter of trial and error testing. Open cell foams, such as Poron 4723, have been found to work adequately, but are not preferred due to a higher modulus of elasticity of about 70 psi.

The initial seal loading of 5 psi is reduced over time by two mechanisms. First, seal element 110 will wear over time, thereby reducing the compression of the energizer element 112. Second, the urethane foam will slow creep at elevated temperatures, which also reduces seal loading. During seal break-in, both the contact pressure and operating temperature of the seal and energizer are gradually reduced. After several hundred hours of pump operation, a stable, long-wearing seal/energizer combination is produced.

The seal element 110 can utilize different long-wearing seal materials, such as filled or unfilled polyimides, Teflon or ultra high molecular weight polyethylene. This material is typically molded into a cylindrical billet and then skived to the desired thickness. The foam is then attached to the seal material, and the foam is ground to the desired overall seal thickness to form a seal sheet. The seal sheet is then cut into the desired spiral shape. Different types of foam, adhesive and seal material can be used within the scope of the invention. For example, the energizer element 112 can be a closed-cell silicone rubber foam, such as the type sold by Furon under its CHR trademark.

In one example, the tip seal 102 had a width parallel to seal surface 116 of 0.094 inch and a thickness perpendicular to seal surface 116 of 0.112 inch. The seal element 110 had a thickness of 0.045 inch, the adhesive 114 had a thickness of 0.002 inch and the energizer element 112 had a thickness of 0.065 inch. The energizer element 112 was urethane foam, and the seal element was ultra high molecular weight polyethylene. The cost of the energizer required to build a pump is about one tenth that of the unsintered Teflon paste. The energizer is furthermore more capable of maintaining adequate seal loading when the pump is first started and after the seal element has worn considerably.

Figure 4:
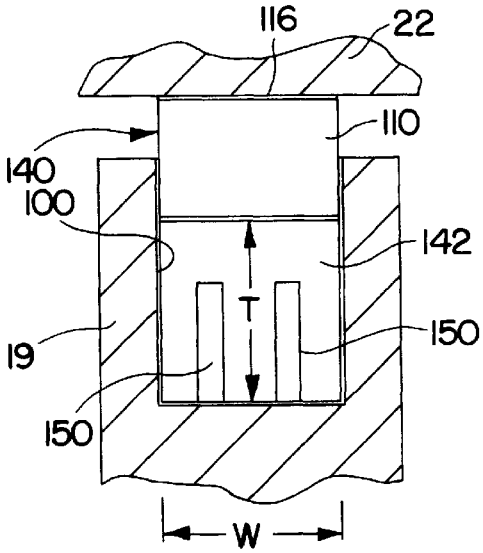
FIG. 4 is an enlarged partial cross-sectional view of a scroll blade, illustrating a second embodiment of the tip seal of the invention.
Figure 5:
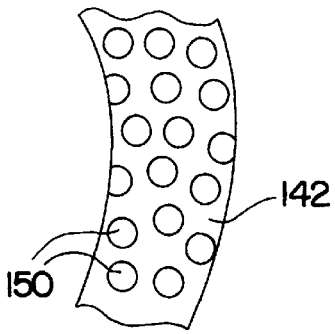
FIG. 5 is a bottom view of the energizer element shown in FIG. 4.

A second embodiment of a tip seal in accordance with the invention is shown in FIGS. 4 and 5. Like elements in FIGS. 3–5 have the same reference numerals. A tip seal 140 includes seal element 110 and an energizer element 142. Energizer element 142 comprises a low modulus of elasticity elastomer material having molded compressible voids. Commercially available low modulus silicone compounds, such as Dow Corning Silastic, have a modulus of elasticity of about 200 psi. When voids of proper geometry are molded into the energizer element 142, the effective modulus of the energizer element can be reduced from about 200 psi to about 100 psi. In the example of FIGS. 4 and 5, energizer element 142 has cylindrical voids 150 extending upwardly from a bottom surface of seal groove 100. The dimensions of the voids 150 are selected to prevent a leakage path across the seal. For an energizer element having a width W of 0.094 inch and a thickness T of 0.058 inch, the cylindrical voids 150 may have diameters of 0.025 inch and heights of 0.050 inch.

A mold for the energizer element 142 can be constructed through a ram EDM process. An array of small holes of proper diameter and depth is drilled into a flat graphite plate. The plate is then used in a ram EDM to electrically machine a steel plate. The plate then has an array of small posts protruding from one side. The plate is incorporated into a rubber molding apparatus to mold a silicone elastomeric sheet onto a Teflon-based sheet of seal material, for example. The Teflon material is typically etched on the molding side for better adhesion. The molded seal assembly has cylindrical holes formed in the silicone elastomer. The seal assembly is cut into a spiral shape and is installed into the seal groove.

The voids in the underside of the energizer element do not present a leakage path, either across the seal or along the seal groove. As the seal assembly is cut, voids may be exposed at the sides of the seal. However, the voids in the elastomer are small enough that a leakage path is not formed across the seal. Along the seal groove, the elastomer material between voids is present to fill the width of the seal groove and thereby block leakage.

It will be understood that the voids 150 are not necessarily formed at the bottom of the energizer element 142 as shown in FIG. 4. The voids 150 may be formed at the top or on the sides of the energizer element or may be internal to the energizer element, within the scope of the invention. In general, the voids 150 permit the energizer element 142 to be compressed, even when the energizer element fills groove 100.

While there have been shown and described what are at present considered the preferred embodiments of the present invention, it will be obvious to those skilled in the art that various changes and modifications may be made therein without departing from the scope of the invention as defined by the appended claims.

What is claimed is:

1. Vacuum pumping apparatus comprising:

a scroll blade set having an inlet and an outlet, said scroll blade set comprising a first scroll blade and a second scroll blade that are nested together to define one or more interblade pockets, at least one of said first and second scroll blades having a seal groove along an edge thereof;

an eccentric drive operatively coupled to said scroll blade set for producing orbiting movement of said first scroll blade relative to said second scroll blade so as to cause said one or more interblade pockets to move toward said outlet; and a tip seal positioned in said seal groove between said first and second scroll blades, said tip seal comprising a seal element and an energizer element affixed to said seal element, said energizer element comprising a resilient material having multiple compressible voids, wherein said energizer element having compressible voids is more compressible than said resilient material alone, when confined by said seal groove, wherein said energizer element comprises a low porosity urethane foam.

2. Vacuum pumping apparatus as defined in claim 1 wherein said foam has a modulus of elasticity no greater than about 40 psi.

3. Vacuum pumping apparatus as defined in claim 1, wherein said energizer element is affixed to said seal element with an adhesive.

4. Vacuum pumping apparatus as defined in claim 1, wherein said compressible voids are compressed when said tip seal is operating in said groove so that said tip seal is effective in inhibiting gas flow upon cold start of the apparatus.

5. In a scroll-type pump including first and second scroll blades that are nested together to define one or more interblade pockets, at least one of said first and second scroll blades having a seal groove along an edge thereof, a tip seal for positioning in said seal groove between said first and second scroll blades, said tip seal comprising:

a seal element; and an energizer element affixed to said seal element, said energizer element comprising a resilient material having multiple compressible voids, wherein said energizer element having compressible voids is more compressible than said resilient material alone, when confined by said seal groove, wherein said energizer element comprises a low porosity urethane foam.

6. Vacuum pumping apparatus comprising:

a scroll blade set having an inlet and an outlet, said scroll blade set comprising a first scroll blade and a second scroll blade that are nested together to define one or more interblade pockets, at least one of said first and second scroll blades having a seal groove along an edge thereof;

an eccentric drive operatively coupled to said scroll blade set for producing orbiting movement of said first scroll blade relative to said second scroll blade so as to cause said one or more interblade pockets to move toward said outlet; and a tip seal positioned in said seal groove between said first and second scroll blades, said tip seal comprising a seal element and an energizer element affixed to said seal element, said energizer element comprising a resilient material having multiple compressible voids, wherein said energizer element having compressible voids is more compressible than said resilient material alone, when confined by said seal groove, wherein said energizer element comprises an elastomer material, wherein said seal groove has a bottom surface and wherein said compressible voids comprise a predetermined pattern of voids that extend upwardly from the bottom surface of said seal groove but do not extend through said energizer element.

7. Vacuum pumping apparatus as defined in claim 6 wherein said voids have predetermined geometries.

8. Vacuum pumping apparatus as defined in claim 6 wherein said elastomer material with compressible voids has a modulus of elasticity no greater than about 100 psi.

9. Vacuum pumping apparatus as defined in claim 6 wherein said elastomer material comprises a silicone compound having a low modulus of elasticity.

* * * * *